US005130000A

United States Patent [19]

Maresch et al.

[11] Patent Number: 5,130,000

[45] Date of Patent: Jul. 14, 1992

[54] PICKLING HIGH-GRADE STEEL

[75] Inventors: Gerald Maresch, Mödling; Erich Mahr, Purkersdorf, both of Austria

[73] Assignee: Andritz-Patentverwaltungs-Gesellschaft m.b.H., Graz, Austria

[21] Appl. No.: 732,817

[22] Filed: Jul. 19, 1991

[30] Foreign Application Priority Data

Jul. 27, 1990 [AT] Austria ..... 1579/90

[51] Int. Cl.[5] ..... C25F 1/06

[52] U.S. Cl. ..... 204/145 R

[58] Field of Search ..... 204/145 R

[56] References Cited

U.S. PATENT DOCUMENTS 4,851,092 7/1989 Maresch ..... 204/145 R 4,994,157 2/1991 Itoh ..... 204/145 R

*Primary Examiner*—T. M. Tufariello

*Attorney, Agent, or Firm*—Ladas & Parry

[57] ABSTRACT

Process for pickling high-grade steel, preferably high-grade steel hot strip, the high-grade steel being subjected to pickling with neutral electrolyte as well as to an after-treatment with mixed acid, nitric acid or a mixture of iron fluoride and hydrofluoric acid, the pickling with neutral electrolyte being preceded by a pre-treatment with sulfuric acid.

9 Claims, No Drawings

PICKLING HIGH-GRADE STEEL

BACKGROUND OF THE INVENTION

The invention relates to a for pickling high-grade steel, preferably high-grade steel hot strip, the high-grade steel being subjected to pickling with neutral electrolyte and a subsequent treatment with mixed acid, nitric acid or a mixture of iron fluoride and hydrofluoric acid.

In the high-grade steel manufacturing industry processes for pickling high-grade steel according to the neutral electrolyte process have become more and more generally adopted in recent years. As is, for example, described in AT-PS 252685, the material is for this purpose pickled in aqueous solutions of neutral alkali salts of mineral acids and subsequently in aqueous solutions of mineral acids, preferably sulfuric acid, both treatment steps being performed electrolytically, i.e. by applying an electric current. As neutral electrolyte an aqueous sodium sulfate solution is preferably employed, and the current densities are in the region of 5 and 15 Amp/dm$^2$. Higher current densities are possible in principle but are not applied because of the higher voltage required due to the poor conductivity of high-grade steel. As is known from AT-PS 387406, the subsequent after-treatment in the acid, in this case preferably mixed acid, can be carried out currentless. The expression mixed acid denotes preferably a mixture of nitric acid and hydrofluoric acid. Pickling with applied currents in mixed acid is not generally practiced because of problems with the electrode material which would have to be current and acid proof.

Despite the satisfactory effectiveness of these known processes with regard to the pickling effect, it was found to be disadvantageous that these processes require a relatively long treatment period. For example, the pickling time in neutral electrolyte and mixed acid for an approximately 3 mm thick high-grade steel hot strip takes about 120 sec., for 6 mm thick high-grade hot strip about 240 sec. and for ferritic hot strip of the quality AISI 430 even up to 270 sec., so that, with a view to a more rapid and more economical production, a demand remained for a shorter pickling process.

Japanese patent application no 55-50468 describes a purely chemical process for pickling chromiferrous high-grade steel. In this case pickling first takes place without current in hydrochloric acid or sulfuric acid and a subsequent after-treatment is performed with $Fe(NO_3)_3$, $FE_2(SO_4)_3$ or $(NH_4)_2S_2O_8$-solution in order to attain a particular degree of whiteness. Scale removal and the attainment of a smooth, white surface is in this context achieved without current and only by the oxidizing after-treatment with salts of trivalent iron, respectively with persulfates. This process cited can, however, only be carried out in ferritic high-grade steel because, although austenitic high-grade steels contain chromium also, the scale is nevertheless composed in an entirely different manner because of the additional alloy element nickel and cannot be removed by this described pickling method alone.

Accordingly a need still exists for a process of the type mentioned in the opening paragraph according to which, while maintaining or even increasing the satisfactory pickling effect achieved up to date, a shortening of the treatment period can be achieved at the same time.

GENERAL DESCRIPTION OF THE INVENTION

According to the invention a process is provided as set out in the opening paragraph, wherein pickling with neutral electrolyte is preceded by a pre-treatment with sulfuric acid.

According to a further feature of the invention, the pre-treatment with sulfuric acid takes place at a temperature of from 60° to 95° C., preferably from 75° to 85° C.

According to a further feature of the invention, the concentration of the sulfuric acid is from 200 to 500 g/l, preferably from 300 to 400 g/l.

According to a further feature of the invention, the pre-treatment with sulfuric acid occupies from 5 to 30% of the total treatment period and pickling in neutral electrolyte from 25 to 50% of the total treatment period.

The advantage of the three-phase pickling process according to the invention resides in the fact that it may be applied both for austenitic (AISI 304 and 316) and ferritic high-grade steel qualities (AISI 430) and that a considerable shortening of the pickling time occurs for both high-grade steel qualities.

Due to the short pre-treatment according to the invention of the high-grade steel, preferably with diluted sulfuric acid before entry into the neutral electrolyte, the pickling time in neutral electrolyte as well as in the subsequent mixed acid can be shortened, thus achieving a substantially increased output in the existing plants with the same space requirements. On the other hand, newly designed plants with the same output as existing plants can be dimensioned considerably smaller and can thus be designed economically more favorable and in a more cost saving manner.

As is the case with conventional pickling processes, the pickling effect in the process according to the invention can likewise be improved by brushing the pickled material between the individual treatments.

Brushing can in this context take place between the pre-treatment with sulfuric acid and the neutral electrolyte pickling, between the neutral electrolyte pickling and the after-treatment in mixed acid or on both occasions, as well as in the rinsing process after the treatment with mixed acid. This brushing does not influence the pickling time, but it reduces the acid consumption, because loosely adhering scale is removed.

DESCRIPTION OF SPECIFIC AND PREFERRED EMBODIMENTS

The invention will now be explained in more detail by way of some non-limiting examples.

WORKING EXAMPLE 1

A high-grade steel hot strip of the quality AISI 304, having a thickness of 3,1 mm, was first pickled in sulfuric acid having a concentration of 350g/l at a temperature of 85° C., and subsequently in mixed acid having a concentration of 25g/l HF and 150g/l $HNO_3$, at a temperature of 55° C., the pickling time being 180 sec. in total and the ratio of the pickling times being 2:1. When using neutral electrolyte, in this case $Na_2SO_4$ having a concentration of 150 g/l, instead of sulfuric acid and subsequent mixed acid after-treatment with the same parameters as described above., the pickling time was reduced to 120 sec, the ratio of the treatment periods now having been 1:1. The polarization of the strip alternated from anodic, at a current density of 10 Amp/dm$^2$, to cathodic, having 20 Amp/dm$^2$, and subsequently back to anodic at 10 Amp/dm$^2$. The temperature of the neutral electrolytes was 80° C. After providing a sulfuric acid pre-treatment phase, the subsequent pickling time in neutral electrolyte could be shortened and the total pickling time reduced to a total of 90 sec., the ratio of the pickling times in the individual stages now amounting to 1:2:4. The concentrations and temperatures in the process according to the invention also corresponded to the above-mentioned values.

WORKING EXAMPLE 2

A high-grade steel hot strip of the quality AISI 315 L, 6 mm thick, was subjected to the same three pickling processes as in working example 1, applying the same process parameters. In this case the pickling time was reduced from 360 sec. in sulfuric acid and mixed acid to 240 sec. in neutral electrolyte and mixed acid and further to 140 sec. with a pre-treatment of sulfuric acid pickling with neutral electrolyte and after-treatment with mixed acid.

WORKING EXAMPLE 3

In the case of a ferritic hot strip of the quality AISI 430 the pickling times for the first two pickling processes according to the aforementioned working examples were approximately 270 sec. each. With additional pre-treatment with sulfuric acid prior to the neutral electrolyte pickling, a reduction of the treatment period to 210 sec. was achieved.

On comparison of the samples of the three applied pickling processes it was found that the surfaces had optically the same degree of reflection, were properly pickled and scale-free.

What we claim is:

1. A process for pickling high-grade steel, the high-grade steel being subjected to pickling with neutral electrolyte and an after-treatment with mixed acid, nitric acid or a mixture of iron fluoride ($FeF_3$) and hydrofluoric acid, wherein pickling with neutral electrolyte is preceded by a pre-treatment with sulfuric acid.

2. A process as claimed in claim 1, wherein the high-grade steel is in the form of hot strip.

3. A process as claimed in claim 1, wherein the pre-treatment with sulfuric acid takes place at a temperature of 60° to 95° C.

4. A process as claimed in claim 3, wherein the pre-treatment takes place at from 75° to 85° C.

5. A process as claimed in claim 1, wherein the concentration of the sulfuric acid is from 200 to 500 g/l.

6. A process as claimed in claim 5, wherein the concentration is from 300 to 400 g/l.

7. A process as claimed in claim 1, wherein the pre-treatment with sulfuric acid occupies from 5 to 30% of the total treatment period and the pickling with neutral electrolyte occupies from 25 to 50% of the total treatment period.

8. A process as claimed in claim 1 wherein the strip is brushed between the pre-treatment with sulfuric acid and a pickling with neutral electrolyte.

9. A process as claimed in claim 1 wherein the strip is brushed between the pickling with neutral electrolyte and the after-treatment with acid.

* * * * *